US007064717B2

(12) United States Patent
Kaluzni et al.

(10) Patent No.: US 7,064,717 B2
(45) Date of Patent: Jun. 20, 2006

(54) HIGH PERFORMANCE LOW COST MONOPOLE ANTENNA FOR WIRELESS APPLICATIONS

(75) Inventors: Heiko Kaluzni, Grossenhain (DE); Michael Wendt, Haselbachtal (DE); Ralf Klukas, Dresden (DE)

(73) Assignee: Advanced Micro Devices, Inc., Austin, TX (US)

( * ) Notice: Subject to any disclaimer, the term of this patent is extended or adjusted under 35 U.S.C. 154(b) by 0 days.

(21) Appl. No.: 10/987,778

(22) Filed: Nov. 12, 2004

(65) Prior Publication Data

US 2005/0140551 A1 Jun. 30, 2005

(30) Foreign Application Priority Data

Dec. 30, 2003 (DE) ..... 103 61 634

(51) Int. Cl.
*H01Q 1/24* (2006.01)
*H01Q 1/38* (2006.01)

(52) U.S. Cl. ..... 343/702; 343/795; 343/846

(58) Field of Classification Search ..... 343/700 MS, 343/796, 830, 846, 876, 702, 795
See application file for complete search history.

(56) References Cited

U.S. PATENT DOCUMENTS 5,990,838 A * 11/1999 Burns et al. ..... 343/702
5,999,132 A * 12/1999 Kitchener et al. ..... 343/702
6,924,768 B1 * 8/2005 Wu et al. ..... 343/702

FOREIGN PATENT DOCUMENTS

DE 19961488 A1 6/2001

* cited by examiner

*Primary Examiner*—Michael C. Wimer
(74) *Attorney, Agent, or Firm*—Williams, Morgan & Amerson

(57) ABSTRACT

A monopole antenna, a monopole antenna system and a data communication device are disclosed in which a high isotropic radiation characteristic is achieved with a minimum substrate area occupied by the antenna. To this end, a substantially T-shaped monopole design is used, wherein end portions of one of the resonating paths are oriented in conformity with respective edges of a substrate.

27 Claims, 2 Drawing Sheets

HIGH PERFORMANCE LOW COST MONOPOLE ANTENNA FOR WIRELESS APPLICATIONS

BACKGROUND OF THE INVENTION

1. Field of the Invention

Generally, the present invention relates to printed antennas used in combination with devices for wireless data communication, and, more particularly, to a printed monopole antenna and devices, such as WLAN devices, mobile phones and the like, requiring compact and efficient antennas.

2. Description of the Related Art

Currently great efforts are being made to develop wireless data communication devices offering a high degree of reliability at low cost. A key issue in this respect is the degree of integration with which a corresponding transceiver device may be manufactured. While for many applications, such as direct broadcast satellite (DBS) receivers and WLAN devices, this is of great importance due to cost-effectiveness, in other applications, such as mobile phones, mobile radio receivers and the like, low power consumption is of primary concern.

Presently, two major architectures for receiver devices are competing on the market, i.e., the so-called direct conversion architecture and the so-called super-heterodyne architecture. Due to the higher degree of integration and the potential for reduction of power consumption, the direct conversion architecture seems to have become the preferred topography compared to the super-heterodyne architecture. However, the advantages achieved by improving the circuit technology may become effective, irrespective of the circuit architecture used, only to an extent as is determined by the characteristics of an antenna required in the high frequency module of the device, wherein the size, the radiation characteristic and the involved production cost of the antenna are also essential criteria that have a great influence on the economic success of the wireless data communication device.

In a typical wireless application, such as wireless data communication system using a local area network (LAN), usually the relative locations of communicating devices may change within a single communication session and/or from session to session. Hence, efficient methods and means have been developed to enhance reliability of the data transfer even for extremely varying environmental conditions, such as in the field of data communication with mobile phones. The overall performance of the wireless devices is, however, determined to a high degree by the properties of the antenna provided at the input/output side of the device. For instance, changing the orientation of a device may significantly affect the relative orientation of the polarization direction of the transmitter with respect to the receiver, which may result in a significant reduction of the field strength received in the receiver's antenna. For instance, changing the orientation of an initially horizontally radiating dipole antenna into the vertical orientation may lead to a reduction of the voltage generated by a horizontally oriented receiver antenna up to approximately 20 dB. Consequently, for non-stationary applications in the wireless data communication system, a substantially isotropic radiation characteristic, independent of the polarization direction, is desirable. On the other hand, with respect to portability and usability of the wireless devices, it is generally desirable that antennas for wireless data communication systems occupy as little volume within the device as possible and to substantially avoid design modifications in the form of, for example, protruding portions and the like. Therefore, increasingly, antennas are provided, which are printed onto a dielectric substrate and connected to the drive/receive circuitry, wherein, in recent developments, the antenna is printed on a portion of the same substrate that also bears the system circuit. Although a moderately compact antenna design is achieved by conventional printed antennas, it turns out to be difficult to provide a highly isotropic characteristic of a dipole antenna when printed on a circuit board.

Thus, great efforts are made to provide efficient and small printed antenna designs with a desired isotropic radiation characteristic. Frequently, a monopole design is used for small volume devices, since the length of the resonant path of a monopole antenna requires only to be equal to a fourth of the wavelength of interest compared to half of the wavelength as is typically used for dipole antennas. The ground plane necessary for producing the mirror currents in a monopole architecture may often be provided without consuming undue substrate area, thereby rendering the monopole antenna an attractive approach for small-sized devices. In IEEE TRANSACTIONS ON ANTENNAS AND PROPAGATION, Vol. 51, No. 9, September 2003, a double T-shaped monopole antenna is described, wherein the length of the resonant paths are selected to enable a dual band operation at 2.4 GHz and 5.2 GHz, respectively. However, the radiation characteristic of the double T antenna with respect to applications requiring a high degree of isotropy is not discussed.

Therefore, a need exists for a printed monopole antenna exhibiting high performance with respect to a desired spatially isotropic radiation characteristic while allowing a low cost and low size design.

SUMMARY OF THE INVENTION

The following presents a simplified summary of the invention in order to provide a basic understanding of some aspects of the invention. This summary is not an exhaustive overview of the invention. It is not intended to identify key or critical elements of the invention or to delineate the scope of the invention. Its sole purpose is to present some concepts in a simplified form as a prelude to the more detailed description that is discussed later.

Generally, in one illustrative embodiment, the present invention is directed to a printed monopole antenna, a system of monopole antennae and data communication devices, wherein an improved radiation characteristic is achieved while the substrate area occupied by the monopole antenna(e) of the present invention is reduced and/or adapted to the substrate shape, thereby providing an improved performance compared to conventional monopole designs.

According to one illustrative embodiment of the present invention, a printed monopole antenna comprises a substrate having a first surface and an opposed second surface and an elongated first resonant portion formed on the first surface and defining a first axis in a longitudinal direction. A second resonant portion is formed on the first surface and has a center piece defining a second axis. The second resonant portion further comprises first and second elongated end pieces forming an angle with the second axis, wherein the second resonant portion extends from the first resonant portion, whereby the second axis is positioned at an angle with the first axis. The antenna further comprises a ground plane formed on the second surface. In one particular embodiment, an edge of each of the first and second end pieces is substantially parallel to a respective edge of the substrate.

According to another illustrative embodiment of the present invention, a printed monopole antenna system comprises a substrate having opposed surfaces. The system further includes a first monopole antenna formed on one of the opposed surfaces and having a first elongated resonant portion and a second resonant portion extending from the first elongated portion to form an angle with an axis extending along the longitudinal direction of the first resonant portion, wherein the second resonant portion is symmetric with respect to the axis. The system further comprises a second monopole antenna formed on one of the opposed surfaces having a second elongated portion defining a second axis that forms an angle with the axis. Moreover, a first ground plane is formed on the other one of the opposed surfaces on which the first monopole antenna is formed. Finally, a second ground plane is formed on the other one of the opposed surfaces on which the second monopole antenna is formed.

According to another illustrative embodiment of the present invention, a data communication device comprises a substrate having a first surface and an opposed second surface. The device also comprises a first printed monopole antenna comprising an elongated first resonant portion formed on the first surface and defining an axis in a longitudinal direction. The first antenna further includes a second resonant portion formed on the first surface and having a center piece defining a second axis. The center piece also comprises first and second elongated end pieces forming an angle with the second axis, wherein the second resonant portion extends from the first resonant portion to form with the second axis an angle with the axis. The first monopole antenna also comprises a ground plane formed on the second surface of the substrate. The data communication device further comprises a drive circuit formed on the substrate, which is connected to the first printed monopole antenna.

BRIEF DESCRIPTION OF THE DRAWINGS

The invention may be understood by reference to the following description taken in conjunction with the accompanying drawings, in which like reference numerals identify like elements, and in which.

Figure 1A:
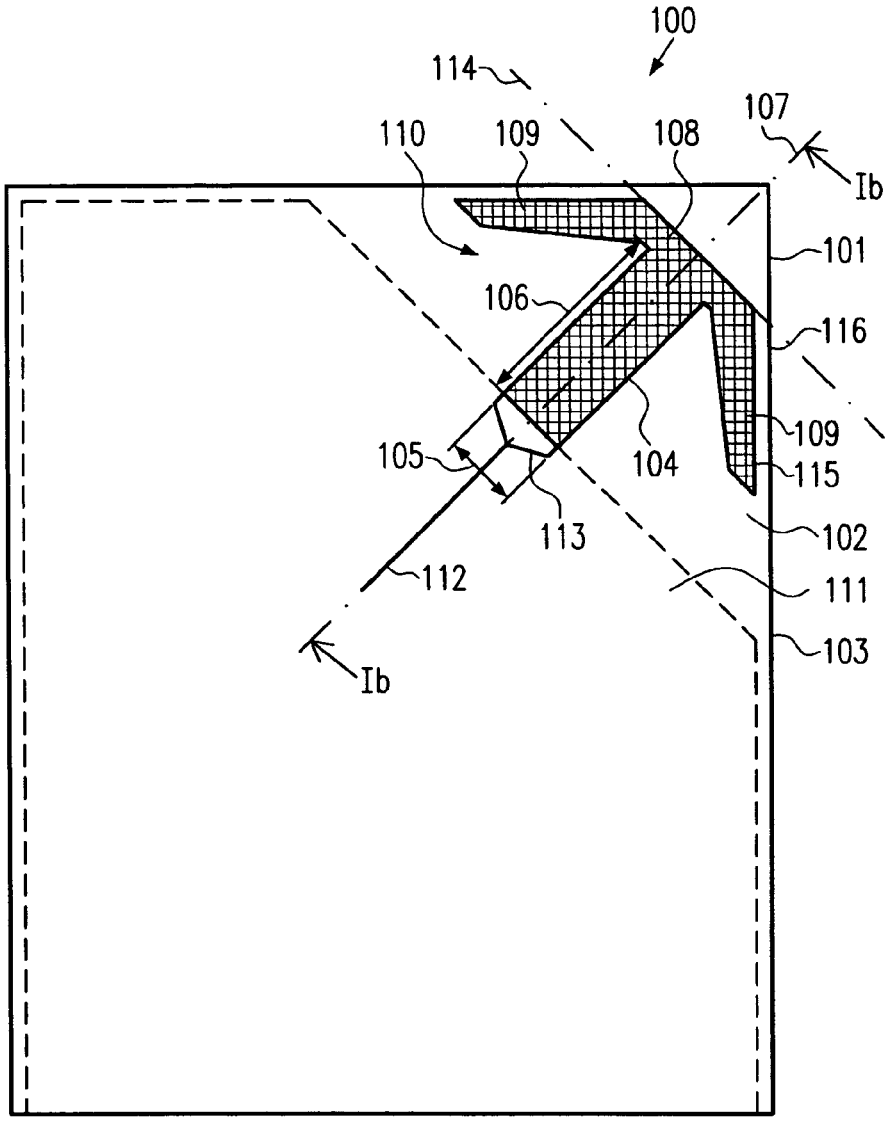
FIGS. 1*a*–1*b* schematically show various views of a printed monopole antenna in accordance with an illustrative embodiment of the present invention.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE INVENTION

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The present invention will now be described with reference to the attached figures. Various structures, systems and devices are schematically depicted in the drawings for purposes of explanation only and so as to not obscure the present invention with details that are well known to those skilled in the art. Nevertheless, the attached drawings are included to describe and explain illustrative examples of the present invention. The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended to be implied by consistent usage of the term or phrase herein. To the extent that a term or phrase is intended to have a special meaning, i.e., a meaning other than that understood by skilled artisans, such a special definition will be expressly set forth in the specification in a definitional manner that directly and unequivocally provides the special definition for the term or phrase.

FIG. 1*a* schematically shows a top view of a printed monopole antenna 100 in accordance with one illustrative embodiment of the present invention. The antenna 100 comprises a substrate 101 having a first surface 102 and a second surface 103 that is located opposite to the first surface 102. The substrate 101 may represent any appropriate substrate, such as an FR4 substrate formed of glass fiber epoxy resin, a substrate made of polyimide, and the like. A thickness of the substrate 101 may be selected in conformity with design requirements, and may be, for instance, in the range of 0.5–1.0 mm, for instance, 0.8 mm±0.1 mm. In one particular embodiment, the substrate 101 is made of epoxy resin with a relative permittivity of approximately 4.4. It should be noted that the substrate 101 may have formed therein further layers including a conductive material, such as copper, to provide increased design flexibility in forming additional circuitry on the substrate 101.

The monopole antenna 100 further comprises a first elongated portion 104 forming a first resonant path of the antenna. The first elongated portion 104 defines an orientation of the antenna 100, for instance, by means of an axis 107 extending along the longitudinal direction of the elongated portion 104. The antenna 100 further comprises a second resonant portion 110, including a center piece 108 and respective end pieces 109, which are connected to the center piece 108. In one particular embodiment, the monopole antenna defined by the first and second resonant portions 104 and 110 is symmetric with respect to the axis 107.

The antenna 100 further comprises a ground plane 111 formed on the second surface 103, as is indicated by dashed lines in FIG. 1*a*. Moreover, a feed line 112 and a corresponding connector portion 113 are formed on the first surface 102 to overlap with the ground plane 111, thereby defining the beginning of the first resonant portion 104.

Figure 1B:
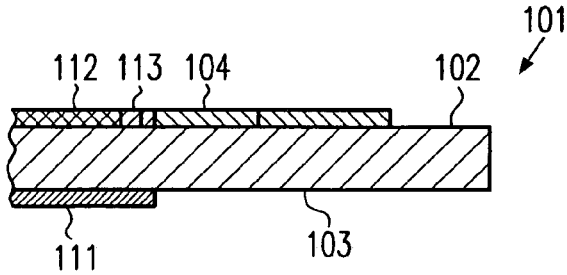

FIG. 1*b* schematically shows a cross-section along the axis 107, wherein the ground plane 111 formed on the second surface 103 overlaps with the feed line 112 and the connector portion 113. The conductive areas formed on the first and second surfaces 102, 103, such as the first and second resonant portions 104, 110, the feed line and the connector portion 112, 113, as well as the ground plane 111, may be formed of copper, wherein a layer thickness may be 17.5 μm, as is typically used in the fabrication of printed circuit boards. It should be appreciated, however, that any other copper thickness may be used, as well as other materials and compounds, such as silver, tin and the like. For instance, the conductive areas of the antenna 100 may be formed of silver, or surface portions of conductive areas, initially formed of copper, may be treated to receive a silver coating and the like.

As previously discussed, a monopole antenna is typically designed to have a resonant length that substantially corresponds to a quarter wavelength of the frequency of interest. In the present example, the monopole antenna 100 may be configured to preferably radiate in a frequency range with a center frequency of 1.2 GHz. Hence, the wavelength of the center frequency is approximately 240 mm so that a total length of the first and second resonant paths 104, 110 of approximately 60 mm is required. It should be appreciated, however, that the monopole antenna 100 may be readily adapted to any required frequency range, such as a range centered about 2.45 GHz by correspondingly scaling the dimensions of the first and second resonant portions 104, 110. Hence, in the present example, a length of the first resonant portion 104, indicated as 106, may be selected to be approximately 22 mm, whereas an effective length of the second resonant portion 110, that is, of the center piece 108 and the end pieces 109, may be selected to be approximately 40 mm. A width 105 of the first resonant portion 104 may be selected to provide a wide conductive line, thereby adjusting the bandwidth of the antenna 100 as required for the specified application. For instance, the width 105, when selected to be approximately 8 mm, results in a bandwidth of approximately 500 MHz defined for a return loss of the antenna 100 of 10 dB and less. It should be appreciated that the desired bandwidth may be readily adjusted by correspondingly varying the width 105, the thickness of the conductive material, such as the copper, used for the first and second resonant portions 104, 110, and by the design of the second resonant portion 110. In one particular embodiment, the center piece 108 of the second resonant portion 110 extends from the first resonant portion 104 in a substantially perpendicular fashion, whereas the end pieces 109 are connected to the center piece 108 under a defined angle with respect to a longitudinal axis 114 of the center piece 108. In one illustrative embodiment, the end pieces 109 are tapered and have an edge 115 that extends in a substantially parallel fashion with respect to edges 116 of the substrate 101. Consequently, as the basic design of the second resonant portion 110 assures for a radiation characteristic of superior isotropy, at the same time a high spatial efficiency is achieved despite the relatively long wavelength, in that the resonant portions 104 and 110 may be arranged at a corner region of the substrate 101, substantially without wasting substrate area that is now available for further circuitry and the like.

In some embodiments, the monopole antenna 100 may comprise respective connector portions (not shown) to connect the antenna 100 to a high frequency circuitry by, for instance, a surface mounting process. Due to the reduced substrate area required for forming the first and second resonant portions 104, 110, the antenna 100 may then be readily stacked on a corresponding circuit board, thereby providing the possibility for producing a plurality of different monopole antennae that are designed for a variety of different center frequencies. In particular, since the monopole antenna 100 as shown in FIGS. 1*a* and 1*b* does not require any contact vias, the manufacturing process is simplified and may be accomplished at low cost.

A typical process flow for forming the antenna 100 involves standard photolithography and etch techniques, thereby rendering the monopole antenna 100 preferable for a cost efficient mass production.

Figure 2:
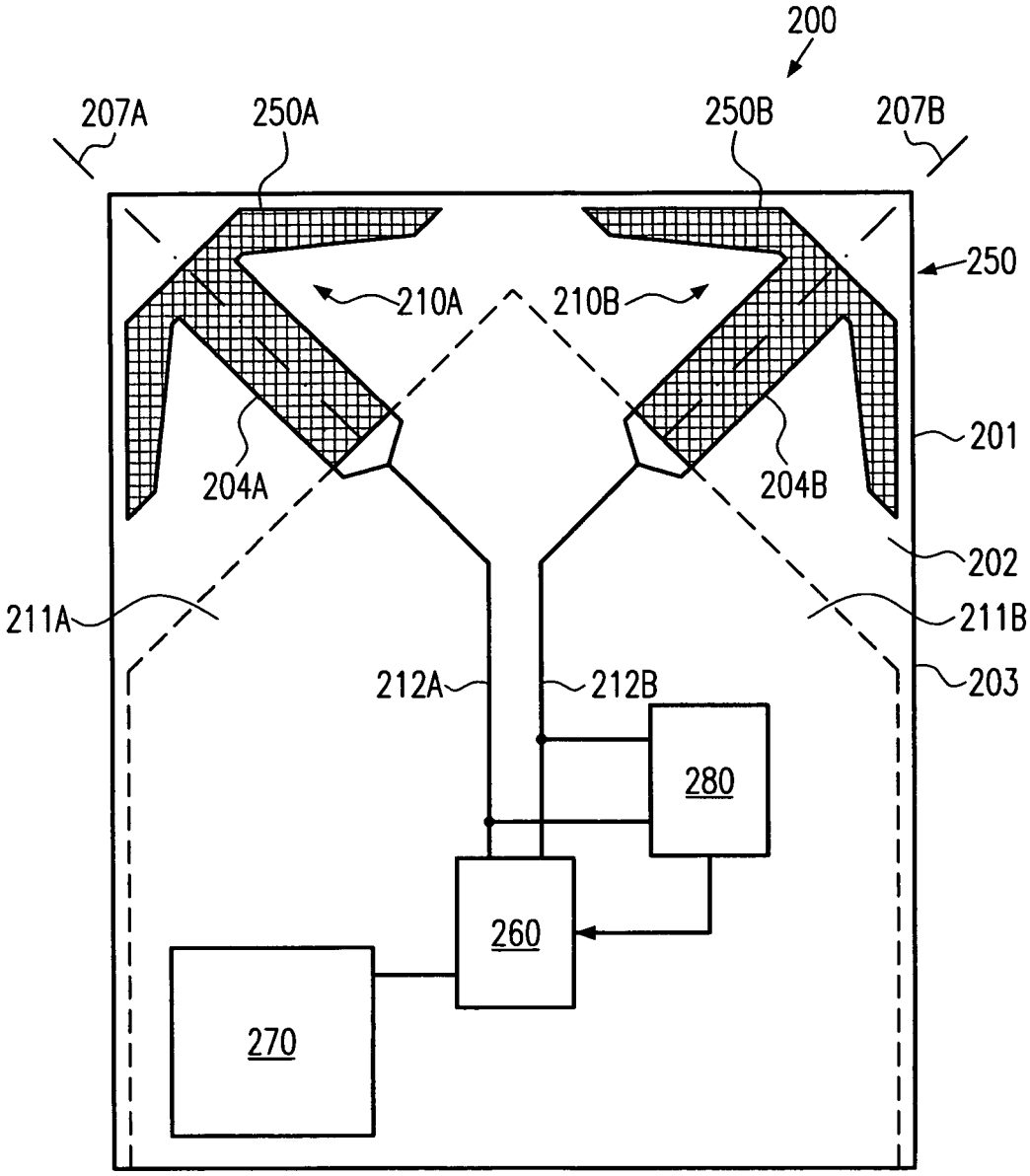
FIG. 2 schematically shows a data communication device including a monopole antenna system in accordance with further illustrative embodiments of the present invention.

With reference to FIG. 2, further illustrative embodiments of the present invention will now be described in more detail, wherein a monopole antenna, such as the antenna 100, is used.

In FIG. 2, a data communication device 200, for instance, a WLAN card for a computer, comprises a substrate 201 having a first surface 202 and a second surface 203 opposed to the first surface 202. A monopole antenna system 250 is formed on the substrate 201, wherein the antenna system 250 may comprise a first monopole antenna 250*a* and a second monopole antenna 250*b*. At least one of the first and second monopole antennae 250*a*, 250*b* has a configuration as is described with reference to FIGS. 1*a* and 1*b*. In one particular embodiment, the first and second monopole antennae 250*a*, 250*b* have substantially the same configuration and differ in their orientations, which are indicated by an axis 207*a* and an axis 207*b*. In one illustrative embodiment, the first orientation represented by the axis 207*a* is substantially orthogonal to the second orientation, represented by the axis 207*b*. In one embodiment, a first resonant portion 204*a* and a second resonant portion 210*a* of the first antenna 250*a* are formed on the first surface 202 and a first resonant portion 204*b* and a second resonant portion 210*b* of the second antenna 250*b* are also formed on the first surface 202. In other embodiments, the first and second resonant portions of one of the first and second antennae 250*a*, 250*b* may be formed on the second surface 203 if such an arrangement is considered appropriate in view of manufacturing and/or design requirements. Furthermore, the antenna system 250 comprises respective first and second ground planes 211*a* and 211*b*, which are formed on a surface that is opposite to the surface on which the first and second resonant portions of the corresponding antennae are formed.

In one particular embodiment, the first and second ground planes 211*a*, 211*b* are commonly formed on the second surface 203, thereby forming a continuous ground plane for the antenna system 250. Regarding the dimensions of the first and/or second antennae, the same criteria apply as previously described with reference to FIG. 1*a*. In one embodiment, the configuration and the dimensions of the first and second antennae 250*a*, 250*b* may be substantially identical, wherein the different orientations 207*a*, 207*b* provide for an enhanced isotropic radiation characteristic when compared to the single antenna 100 of FIG. 1*a*. In other embodiments, for instance, the second antenna 250*b* may differ in dimensions from the first antenna 250*a*, wherein the dimensions of the second antenna may be selected to cover a frequency range that differs from that of the first antenna 250*a*. Since both antennae exhibit a moderately high isotropic radiation characteristic, a sufficient operational behavior may be obtained for both frequency ranges despite the different orientations 207*a*, 207*b*, while at the same time a spatially highly efficient arrangement is achieved even if the frequencies involved are moderately low, such as 1.2 GHz and 2.45 GHz.

The data communication device 200 may further comprise a switching circuit 260, which is connected with one side to corresponding feed lines 212*a*, 212*b* of the antenna system 250, and which is connected to a drive/receive circuit 270. Moreover, in one embodiment, a comparator circuit 280 may be provided, which is connected to the feed lines 212*a*, 212*b*, and to the switching circuit 260. The comparator circuit 280 is configured to receive respective high frequency signals from the first and second antennae 250*a*, 250*b*, and to identify the magnitude of respective levels of these signals, or at least to recognize the signal having the higher level. The switching circuit 260 may be configured to selectively connect the drive/receive circuit 270 to one of the feed lines 212*a*, 212*b*.

During the operation of the data communication device 200, the signal levels on the feed lines 212*a*, 212*b* may be monitored continuously or on a regular basis by the comparator circuit 280, which then supplies a result of the comparison to the switching circuit 260, which may then select the feed line providing the higher signal level. Hence, the drive/receive circuit 270 may then be connected to the antenna that provides an enhanced signal level with respect to a remote device with which a data communication line is established. Therefore, due to the different orientations 207*a*, 207*b*, a highly reliable connection to a remote device may be established, irrespective of the relative orientation of the device 200 to the remote device, since the different orientation of the antennae 250*a*, 250*b* assures a high sensitivity for all directions, while the monopole design per se provides for a low sensitivity to a change in polarization of an incoming radiation. Additionally, the adaptation of the antenna design, especially when the first and second antennae 250*a*, 250*b* have substantially the same configuration, to the substrate dimensions provides a superior performance at a reduced substrate area that is required for positioning the antenna system 250 within the substrate 201. Hence, a common circuit layout may be designed for the electronic components forming the circuit 270, 260 and 280 and for the antenna system 250, thereby significantly lowering manufacturing costs. In other embodiments, individual antennae 100, as shown in FIGS. 1*a* and 1*b*, may be individually manufactured at low cost, and may then be attached to a circuit board, wherein the orientation and dimensions of the individual antennae may be selected in accordance with device requirements. For example, two or more of the antennae as described with reference to FIGS. 1*a* and 1*b* may be mounted to a printed circuit board, preferably at corner portions thereof, to provide an enhanced isotropic radiation characteristic and/or for operation at two or more different frequency bands. Similarly, in one embodiment, a first antenna system, such as the system 250, may be formed on one side of a circuit board, whereas a second antenna system, having the same configuration as the system 250 but tuned to a different frequency range, may be formed on the other side of the circuit board or immediately adjacent to the first antenna system, wherein the additional circuitry is also formed on the same substrate. In this way, a dual band operation with excellent isotropic radiation characteristics may be accomplished even for moderately long wavelength ranges, wherein, due to the spatially highly efficient configuration of the present invention, a minimum of substrate area is occupied by the monopole antenna systems.

As a result, the present inventions provides a printed monopole antenna design that enables a high performance at reduced substrate area, wherein two or more individual antennae may be positioned in corner regions of a substrate. The different orientation obtained by the different substrate positions of the two or more individual antennae may even further increase the isotropic radiation characteristic.

The particular embodiments disclosed above are illustrative only, as the invention may be modified and practiced in different but equivalent manners apparent to those skilled in the art having the benefit of the teachings herein. For example, the process steps set forth above may be performed in a different order. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed:

1. A printed monopole antenna, comprising:

a substrate having a first surface and an opposed second surface;

an elongated first resonant portion formed on said first surface and defining a first axis in a longitudinal direction;

a second resonant portion formed on said first surface and having a center piece, defining a second axis, and first and second elongated end pieces forming an angle with said second axis, said second resonant portion extending from said first resonant portion, wherein said second axis is positioned at an angle with said first axis and an outer edge of each of said first and second end pieces is disposed proximate respective edges of said substrate; and a ground plane formed on said second surface.

2. The printed monopole antenna of claim 1, wherein said second resonant portion is symmetric with respect to said first axis.

3. The printed monopole antenna of claim 2, wherein the outer edges of said first and second end pieces are substantially parallel to respective edges of said substrate.

4. The printed monopole antenna of claim 2, wherein outer edges of said first and second end pieces are oriented to each other in a substantially perpendicular fashion.

5. The printed monopole antenna of claim 2, wherein said second axis is substantially orthogonal to said first axis.

6. The printed monopole antenna system of claim 1, wherein said first and second end portions are tapered.

7. A printed monopole antenna system, comprising;

a substrate having opposed surfaces;

a first monopole antenna formed on one of said opposed surfaces and having a first elongated resonant portion and a second resonant portion extending from said first elongated portion to form an angle with a first axis extending along the longitudinal direction of said first resonant portion, said second resonant portion being symmetric with respect to said first axis;

a second monopole antenna formed on one of said opposed surfaces having a second elongated portion defining a second axis that forms an angle with said first axis;

a first ground plane formed on the other one of said opposed surfaces on which said first monopole antenna is formed; and a second ground plane formed on the other one of said opposed surfaces on which said second monopole antenna is formed.

8. The printed monopole antenna system of claim 7, wherein said second monopole antenna is identical in configuration to said first monopole antenna.

9. The printed monopole antenna system of claim 7, wherein said second resonant portion comprises an elongated center portion extending from said first resonant portion, and first and second end portions connected to said center portion, said first and second end portions forming an angle with said center portion.

10. The printed monopole antenna system of claim 9, wherein an outer edge of said first and second end portions are substantially orthogonal to each other.

11. The printed monopole antenna system of claim 7, wherein said first and second ground planes form a continuous conductive area.

12. The printed monopole antenna system of claim 7, wherein said first ground plane has a first edge that is substantially perpendicular to said axis of said first monopole antenna.

13. The printed monopole antenna system of claim 12, wherein said second ground plane has a second edge that is substantially perpendicular to said second axis of said second monopole antenna.

14. The printed monopole antenna system of claim 7, wherein said first axis is substantially perpendicular to said second axis.

15. The printed monopole antenna system of claim 7, wherein said first and the second monopole antennas are formed on said first surface.

16. The printed monopole antenna system of claim 9, wherein said first and second end portions are tapered.

17. A data communication device, comprising:

a substrate having a first surface and an opposed second surface;

a first printed monopole antenna comprising:

an elongated first resonant portion formed on said first surface and defining a first axis in a longitudinal direction;

a second resonant portion formed on said first surface and having a center piece defining a second axis and first and second elongated end pieces forming an angle with said second axis, said second resonant portion extending from said first resonant portion, wherein said second axis is positioned at an angle with said first axis and an outer edge of each of said first and second end pieces is disposed proximate respective edges of said substrate; and a ground plane formed on said second surface; and a drive circuit formed on said substrate, said drive circuit being connected to said first printed monopole antenna.

18. The data communication device of claim 17, wherein said second resonant portion is symmetric with respect to said first axis.

19. The data communication device of claim 17, wherein the outer edges of said first and second end pieces are substantially parallel to respective edges of said substrate.

20. The data communication device of claim 18, wherein outer edges of said first and second end pieces are oriented to each other in a substantially perpendicular fashion.

21. The data communication device of claim 17, wherein said second axis is substantially orthogonal to said first axis.

22. The data communication device of claim 17, further comprising a second printed monopole antenna having a second orientation that differs from a first orientation of said first monopole antenna.

23. The data communication device of claim 22, wherein said second monopole antenna is substantially identical in configuration to said first monopole antenna.

24. The data communication device of claim 23, wherein said first orientation and said second orientation are substantially orthogonal to each other.

25. The data communication device of claim 17, further comprising a comparator circuit connectable to said first and second monopole antennas and configured to compare a first signal level obtained from said first monopole antenna with a second signal level obtained from said second monopole antenna.

26. The data communication device of claim 25, further comprising a switching circuit connected to said first and second monopole antennas, said comparator circuit and said drive circuit, said switching circuit being configured to selectively connect said first or second monopole antennas to said drive circuit upon a result from said comparator circuit.

27. The data communication device of claim 17, wherein said first and second end portions are tapered.

* * * * *